US007395761B2

(12) United States Patent
Bittle et al.

(10) Patent No.: US 7,395,761 B2
(45) Date of Patent: Jul. 8, 2008

(54) VARIABLE-FORCE PAYLOAD EJECTING SYSTEM

(75) Inventors: David A. Bittle, Somerville, AL (US); Gary T. Jimmerson, Athens, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 437 days.

(21) Appl. No.: 11/326,677

(22) Filed: Dec. 19, 2005

(65) Prior Publication Data

US 2007/0152101 A1 Jul. 5, 2007

(51) Int. Cl.
*F42B 12/58* (2006.01)
*B64D 1/02* (2006.01)

(52) U.S. Cl. ..... 102/489; 244/136; 244/137.4

(58) Field of Classification Search ..... 244/136, 244/137.1, 137.4, 1 TD, 63; 102/489, 505; 89/1.54; 342/9
See application file for complete search history.

(56) References Cited

U.S. PATENT DOCUMENTS 3,095,814 A * 7/1963 Jansen et al. ..... 102/377
3,295,410 A * 1/1967 Edwards ..... 89/1.51
3,355,751 A * 12/1967 McGroarty ..... 441/81
3,380,687 A * 4/1968 Ford et al. ..... 244/173.3
4,031,828 A * 6/1977 Larson ..... 102/505
4,088,287 A * 5/1978 Hasquenoph et al. .... 244/137.4
4,164,887 A * 8/1979 Ouellette ..... 89/1.51
4,187,761 A * 2/1980 Holt et al. ..... 89/1.51
4,444,085 A * 4/1984 Dragonuk ..... 89/1.51
4,466,334 A * 8/1984 Holtrop ..... 91/45
4,520,975 A * 6/1985 Blackhurst ..... 244/137.4
4,714,020 A * 12/1987 Hertsgaard et al. ..... 102/351
4,807,534 A * 2/1989 Vockensperger et al. .... 102/489
5,005,481 A * 4/1991 Schneider et al. ..... 102/393
5,033,390 A * 7/1991 Minert et al. ..... 102/530
5,063,823 A * 11/1991 Marshall et al. ..... 89/1.51
5,070,760 A * 12/1991 Marshall et al. ..... 89/1.51
5,107,749 A * 4/1992 Norrvi ..... 89/1.57
5,107,767 A * 4/1992 Schneider et al. ..... 102/393
5,210,372 A * 5/1993 Tripptrap et al. ..... 102/489
5,220,124 A * 6/1993 Pennington et al. ..... 89/1.51

(Continued)

FOREIGN PATENT DOCUMENTS

GB 2267556 A * 12/1993

*Primary Examiner*—Michael R. Mansen
*Assistant Examiner*—Joseph W Sanderson
(74) *Attorney, Agent, or Firm*—Hay Kyung Chang

(57) ABSTRACT

The Variable-Force Payload Ejecting System, residing within an air vehicle, utilizes multiple pressure generators, one or more of which may be activated, to produce variable levels of force. A controlling computer within the air vehicle determines when and how much pressure needs to be generated to eject a given item, such as a submunition, from the vehicle. In its determination, the computer factors in the vehicle's forward velocity and height over the intended target at the time of ejection and the characteristics of the particular submunition to be ejected. An activating mechanism activates one or more pressure generators to produce the determined amount of pressure. The pressure thusly generated acts on an inflatable tube that inflates and expels the selected submunition. The result is a more precise delivery of the submunitions onto the intended targets.

20 Claims, 4 Drawing Sheets

U.S. PATENT DOCUMENTS 5,225,627 A * 7/1993 Phillips et al. ..... 102/351
5,231,928 A * 8/1993 Phillips et al. ..... 102/351
5,333,528 A * 8/1994 Klestadt et al. ..... 89/1.51
5,915,694 A * 6/1999 Brum ..... 273/359
6,284,966 B1 * 9/2001 Simburger et al. ..... 136/244
6,481,669 B1 * 11/2002 Griffin ..... 244/137.4
6,498,767 B2 * 12/2002 Carreiro ..... 367/4
6,543,715 B1 * 4/2003 Karpov et al. ..... 244/2
6,666,145 B1 * 12/2003 Nardone et al. ..... 102/489
6,672,220 B2 * 1/2004 Brooks et al. ..... 102/489
6,676,083 B1 * 1/2004 Foster et al. ..... 244/137.4
6,679,454 B2 * 1/2004 Olsen et al. ..... 244/137.1
6,834,593 B2 * 12/2004 Nardone et al. ..... 102/489
6,857,596 B1 * 2/2005 Carlson ..... 244/1 TD
6,905,097 B2 * 6/2005 Blackwell-Thompson et al. ..... 244/173.1
7,032,521 B2 * 4/2006 Ronn et al. ..... 102/489
7,168,368 B1 * 1/2007 Warner et al. ..... 102/489
7,278,416 B2 * 10/2007 Larcheveque et al. ..... 124/72
2006/0214062 A1 * 9/2006 Shim et al. ..... 244/137.1

* cited by examiner

VARIABLE-FORCE PAYLOAD EJECTING SYSTEM

DEDICATORY CLAUSE

The invention described herein may be manufactured, used and licensed by or for the Government for U.S. governmental purposes; provisions of 15 U.S.C. section 3710c apply.

BACKGROUND OF THE INVENTION

In the current state of the art in the field of ejection of an item, such as submunition or munition, from an air vehicle, there are essentially three standard techniques. The first technique involves ejecting a payload of submunitions through the nose of the vehicle by an explosive charge located behind the payload. This technique is used primarily with flechette or rod type submunitions. The second technique involves ejecting the payload through the side of the air vehicle (radial ejection). In the third technique, the submunitions are ejected from the rear of the air vehicle (axial ejection).

In all of these techniques, the ejecting system is designed for a single type of submunition and utilizes a single level of force. Such an ejecting system cannot compensate for variations in the velocity of the air vehicle, the height from which the item (submunition) is ejected or any other factors that can affect the precision placement of the submunitions in actual (battlefield) use.

Further, the submunitions ejected using any of the above three techniques are ejected either simultaneously or in a very rapid sequence so that all are placed into the same target area. Multiple target areas separated by some distance cannot be accommodated by a single air vehicle. Finally, the radial ejection technique, in particular, leads to high shock and acceleration loads on the submunitions, since the ejecting system must break any restraining straps that hold the submunitions in place in the air vehicle before the submunitions can be separated from the air vehicle.

What is needed is an ejecting mechanism that can drop various submunitions as required onto different target areas that may be separated by various distances. Such an ejecting system should take into account the changing flight speed of the air vehicle, its height over the intended target area and the aerodynamic characteristics of the particular submunition selected for ejection, in order to produce the level of force necessary to eject the submunition so that it lands on the intended target.

SUMMARY OF THE INVENTION

The Variable-Force Payload Ejecting System, residing within the air vehicle, incorporates multiple pressure generators to produce variable levels of submunition ejection force. A controlling computer within the air vehicle determines when and how many of the pressure generators need to be activated, depending upon factors such as the vehicle's forward velocity and height over the intended target at the time of ejection and the characteristics of the particular submunition to be ejected. The force (power) produced by the activated pressure generators acts on an ejecting device, such as an inflatable tube, to expel the selected submunition from the air vehicle.

The result is a more precise delivery of the submunitions onto the intended targets. The precision and accuracy is particularly notable when the variable-force ejecting system is combined with an axial ejection technique.

Additionally, the variable-force ejecting system allows ejection of individual submunitions from a payload (each individual submunition having its own ejecting device) either in a very rapid sequence so that all are placed into a single target area or individually or in groups so that multiple target areas, separated by some distances, can be addressed by the same air vehicle. Such ejections over multiple target areas will be chronologically separate as well.

DESCRIPTION OF THE PREFERRED EMBODIMENT

Figure 1A:
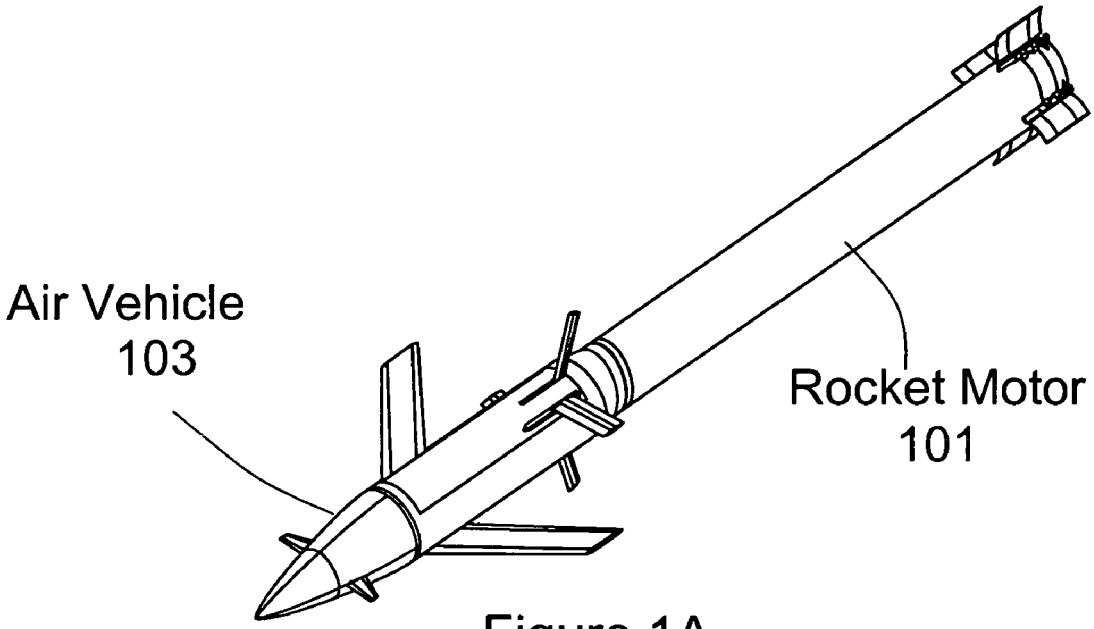
FIG. 1A shows an air vehicle 103 (propelled by rocket motor 101) with which the variable-force ejecting system can be used.

Referring now to the drawing wherein like numbers represent like parts in each of the several figures, the composition and function of a representative variable-force ejecting system is explained in detail.

Any and all of the numerical dimensions and values that follow should be taken as nominal values rather than absolutes or as a limitation on the scope of the invention. These nominal values are examples only; many variations in size, shape and types of materials may be used, as will readily be appreciated by one skilled in the art, as successfully as the values, dimensions and types of materials specifically set forth hereinafter. In this regard, where ranges are provided, these should be understood only as guides to the practice of this invention.

Figure 2A:
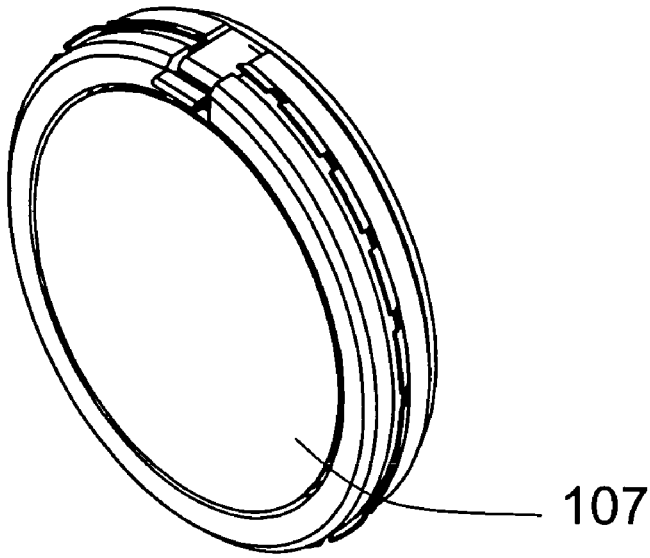
FIG. 2A is a view of a representative variable-force ejecting system 107 prior to activation.
Figure 2B:
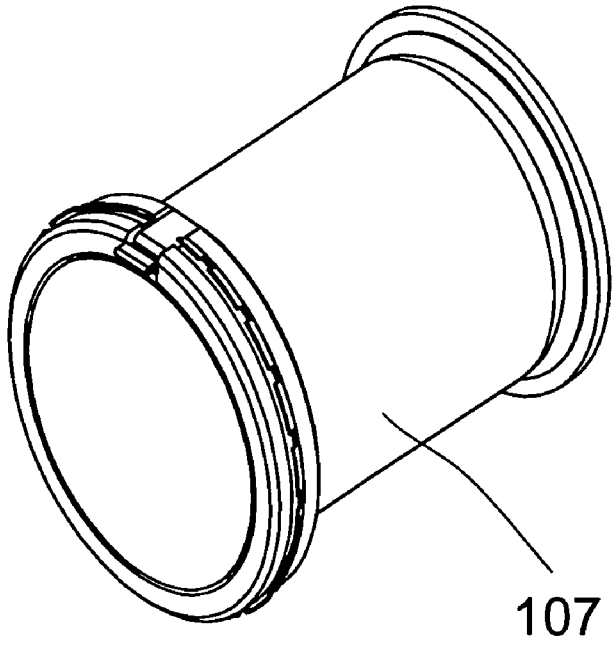
FIG. 2B is a view of a representative variable-force ejecting system after activation.

FIG. 2A shows a representative variable-force ejecting system in its inactivated state while FIG. 2B shows the ejecting system activated and ready to expel an item (submunition) 301.

Figure 1B:
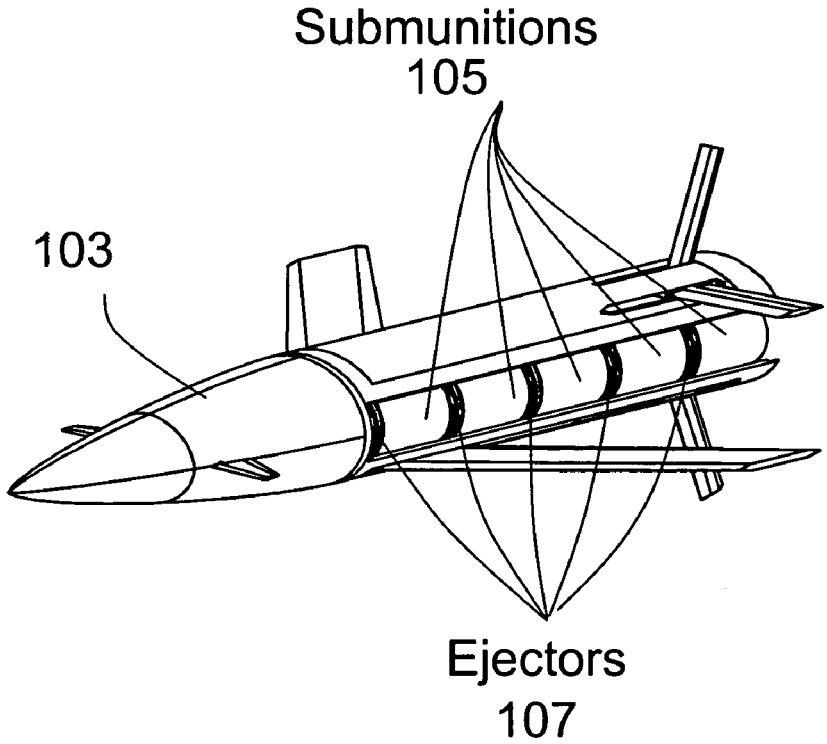
FIG. 1B shows the relative positions of multiple variable-force ejecting systems 107 and their corresponding submunitions 105 inside the air vehicle.

As illustrated in FIG. 1B, air vehicle 103 may carry within it many such ejecting systems and submunitions. They may be arranged in multiple rows, each row containing a plurality of ejecting systems and submunitions in a pattern of alternating ejecting systems and submunitions. The submunitions depicted in FIG. 1B are ejected axially from the air vehicle after rocket motor 101 burns out and falls away from the air vehicle.

FIG. 1A shows an air vehicle 103 with which the variable-force payload ejecting system may be used. The variable-force payload ejecting system is intended to reside inside the air vehicle. A particular advantage of the variable-force payload ejecting system as described herein is that it can be used with a wide variety of submunitions or munitions presently in inventory or in current development.

Figure 3:
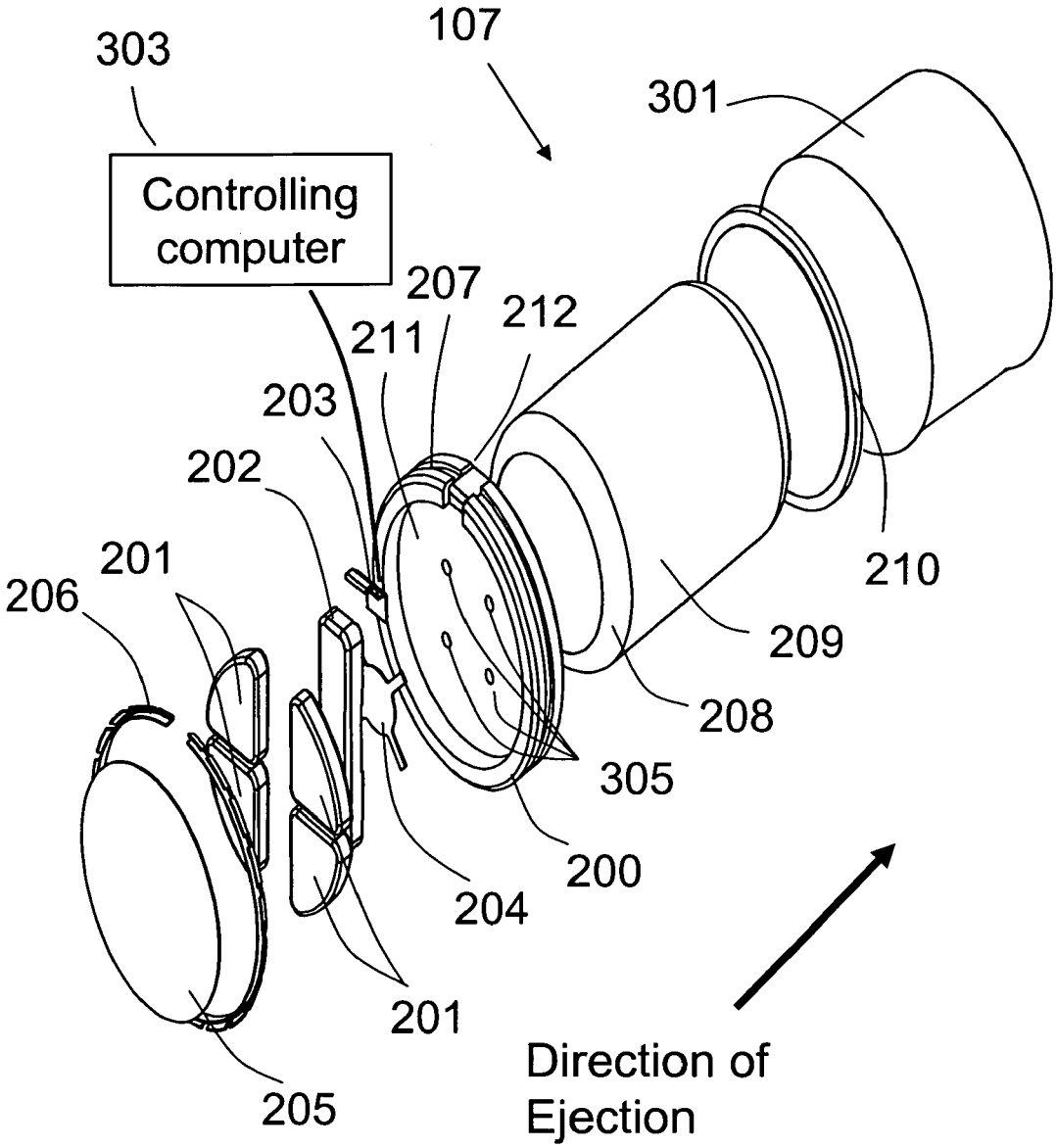
FIG. 3 is an exploded view of a preferred embodiment of a representative variable-force ejecting system 107.
Figure 4:
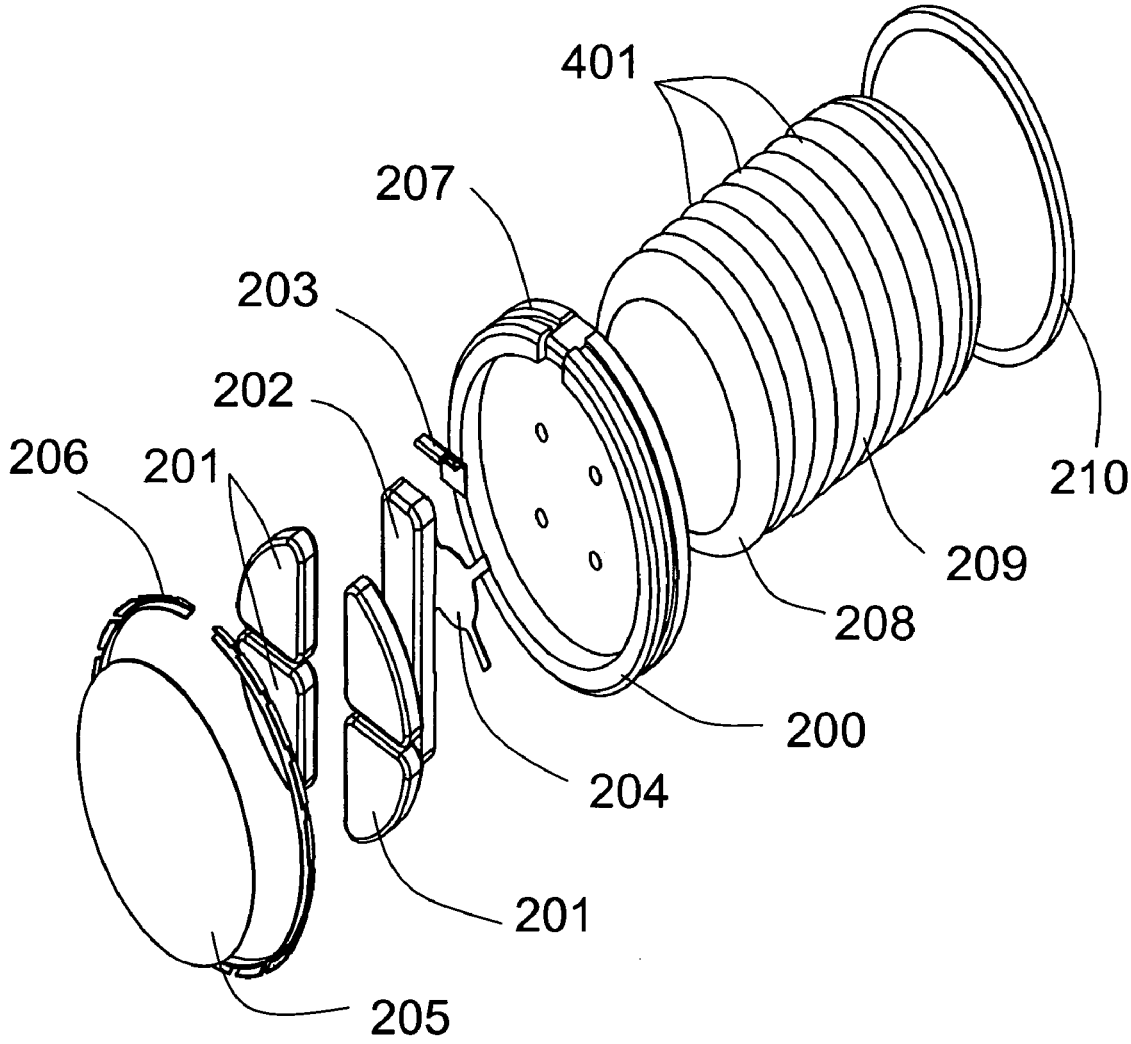
FIG. 4 depicts a preferred embodiment of a representative variable-force payload ejecting system for submunitions that require rotation to activate their arming sequence prior to ejection.

A preferred embodiment of the variable-force payload ejecting system is depicted in FIG. 3 which presents an exploded view of the ejecting system.

The ejecting system 107 comprises a plurality of pressure generators 201 and an inflatable tube 209 that is coupled to the generators to receive the gas generated by the pressure generators.

One or more of the generators may be activated by electronics module 202 via flex circuit card (signal path) 204. The electronics module activates the generators in response to output signals received via electrical connector 203 from the air vehicle's controlling computer 303. The activation of one or more of the generators results in the production of the amount of pressure necessary to inflate the tube so as to eject from the air vehicle submunition 301, which is positioned adjacent to inflatable tube 209.

The electronics module 202 may also perform over-all "health checks" on the ejecting system to assure that all components of the ejecting system are functioning properly prior to the activation of the pressure generators and to provide feedback to the air vehicle controlling computer 303, also via electrical connector 203, upon ejection of submunition, that an ejection has indeed occurred.

FIG. 3 shows four pressure generators, but the number could be more or less, depending on the degree of control desired over how rapidly the tube inflates and how forcefully it pushes the submunition out of the vehicle. The higher the number of pressure generators utilized, the higher the likely cost and the degree of complexity of the ejecting system.

The amount of necessary pressure for any given ejection is calculated by air vehicle controlling computer 303 based on, among other factors, the forward velocity of the air vehicle and the height of the vehicle over the intended target at the time of the ejection, the particular submunitions to be ejected and the particular submunitions' position inside the air vehicle. The computer generates output signals indicative of the amount of the calculated necessary pressure. These output signals are communicated to electronics module 202 via electrical connector 203.

Whether one or more of such ejecting systems, among multiple ejecting systems as shown in FIG. 1B, should be actuated in rapid succession or with time intervals in between depends on whether the submunitions are to be ejected in rapid succession or with recognizable time intervals between ejections.

Pressure generators 201, electronics module 202, electrical connector 203 and flex circuit card 204 may be fixedly attached onto first face 211 of base plate 200 that slides into the payload bay of the vehicle, making certain that each of the pressure generators is aligned with one of gas passages 305. The passages are bored through the base plate so as to communicate first face 211 and second face 212 of the base plate with each other.

The pressure gas generated by the pressure generators travels through the passages to enter inflatable tube 209 which is permanently coupled to the second face of the base plate via attachment ring 208. In response to the entering gas, the tube inflates and pushes submunition 301 out of the air vehicle.

Angled ring 206, which engages matching groove 207 in the rim of the base plate, removably locks into place against the payload bay wall of the air vehicle, allowing the tube to push the submunition toward the rear of the air vehicle while keeping the entire ejecting system from moving backwards (in opposite direction from the ejection direction) in the payload bay and possibly damaging other remaining submunitions and their respective ejecting systems. When the second submunition is pushed from the air vehicle, the ejecting system that ejected the first submunition is also ejected from the vehicle along with the second submunition.

Although a particular embodiment and form of this invention has been illustrated, it is apparent that various modifications and embodiments of the invention may be made by those skilled in the art without departing from the scope and spirit of the foregoing disclosure. One such variation is face cover 205 which can be placed over the pressure generators, electronics module, flex circuit card and the electrical connector to protect them from any damage.

Some submunitions that can be ejected using the Variable-Force Payload Ejecting system require rotation to activate their arming sequence. With such submunitions, another variation to the ejecting system involves rotation plate 210 which is fixedly attached to inflatable tube 209 by helical stiffener 401 that is coupled to the fabric of the tube. The stiffener may be incorporated into the body of the inflatable tube during the manufacturing process, either by weaving the tube's expandable fabric around a metallic or non-metallic helical inclusion, by permanently bonding it to the expandable fabric using a suitable adhesive or by simply sewing helical seams into the fabric using a suitable thread material. When the tube inflates and extends, helical stiffener 401 extends as well, spinning at a pre-determined rate. The stiffener thus unwinds as it extends, straightening the inflatable tube which was twisted as it was folded during manufacture. The twisting (unwinding) motion at the pre-determined spin rate is transferred to the submunition through rotation plate 210, causing the submunition fuze to sense a linear acceleration and a roll rate and, in response, initiate the arming process.

Some suitable materials for the base plate, face cover and the attachment ring are high-strength aluminum alloy, corrosion-resisting steel or composite material. For the pressure generators, high-strength, corrosion-resisting steel is recommended. The angled ring should be made of a steel alloy spring material. The inflatable tube should be made of a flexible material that is resistant to heat and impermeable to the pressurizing gas. Kevlar weave would be a good choice. The rotation plate should be made of a rigid material such as aluminum alloy or a high-strength plastic.

There may be other suitable variations or modifications within the ken of those skilled in the art. Accordingly, the scope of the invention should be limited only by the claims appended hereto.

We claim:

1. A Variable-Force Payload Ejecting System for selectively ejecting items from the payload bay of an air vehicle, said air vehicle having therein a controlling computer for calculating amounts of pressure necessary for variously-timed ejections and producing output signals indicative of said calculated necessary amounts of pressure, said ejecting system residing within the air vehicle and comprising: a plurality of pressure generators; an electronics module coupled to the controlling computer, said electronics module activating at least one of said pressure generators in response to the output signals from the controlling computer to produce the calculated necessary amount of pressure at pre-determined times; an inflatable tube positioned adjacent to the items; a helical stiffener fixedly attached to said inflatable tube and producing a pre-selected spin rate to the items; and a means to transmit the pressure from said generator to said tube so as to cause said tube to inflate and thereby eject the items such that the items fall on pre-selected loci.

2. A Variable-Force Payload Ejecting System as set forth in claim 1, wherein said electronics module is coupled to said controlling computer via an electrical connector.

3. A Variable-Force Ejecting System as set forth in claim 2, wherein said ejecting system further comprises: a flex circuit card, said card being coupled between said electronics module and said pressure generators, said card providing a signal path.

4. A Variable-Force Ejecting System as set forth in claim 3, wherein said ejecting system still further comprises: a base plate having first and second faces, said faces being opposite from each other.

5. A Variable-Force Ejecting System as set forth in claim 4, wherein said transmitting means is a plurality of passages bored through said base plate and communicating said first and second faces with each other, the number of said passages equaling the number of said pressure generators.

6. A Variable-Force Ejecting System as set forth in claim 5, wherein said base plate is coupled via said second face to said inflatable tube.

7. A Variable-Force Ejecting System as set forth in claim 6, wherein said pressure generators, electronics module, electrical connector and circuit card are mounted onto said first face of said base plate, said pressure generators being aligned with said passages so as to allow pressure to travel through said passages from said generators to said inflatable tube.

8. A Variable-Force Ejecting System as set forth in claim 7, wherein said electronics module provides feedback to the controlling computer confirming activation of said pressure generators.

9. A Variable-Force Ejecting System as set forth in claim 8, wherein said base plate has a groove along the rim of said base plate.

10. A Variable-Force Ejecting System as set forth in claim 9, wherein said ejecting system still further comprises an angled ring, said angled ring engaging said groove and removably anchoring onto the payload bay wall so as to prevent said ejecting system from moving in a direction opposite from the ejection direction.

11. A Variable-Force Ejecting System as set forth in claim 10, wherein said ejecting system still further comprises a face cover to cover and protect said pressure generators, electronics module, electrical connector and circuit card.

12. A Variable-Force Payload Ejecting System for selectively ejecting an item from an air vehicle, the air vehicle having an exit at the rear, at a pre-selected time during the flight of the air vehicle such that the item drops on an intended target, the air vehicle containing therein a controlling computer for determining the ejection force necessary to eject the item at the pre-selected time, said ejecting system residing in the air vehicle and comprising: a plurality of pressure generators for producing a variable ejection force; a means to activate sufficient number of said generators to produce ejection force pre-determined by the controlling computer, said activating means cooperating with the controlling computer; an inflatable tube comprised of expandable fabric, said tube being positioned adjacent to the item; a helical stiffener fixedly attached to said inflatable tube and producing a pre-selected spin rate to the item; and a means to transmit the pressure from said generators to said tube so as to inflate said tube and thereby eject the item through the exit such that the item falls on the intended target.

13. A Variable-Force Payload Ejecting System for selectively ejecting an item from an air vehicle at a pre-selected time during the flight of the air vehicle as set forth in claim 12, wherein said activating means is an electronics module coupled between said controlling computer and said pressure generators.

14. A Variable-Force Payload Ejecting System as set forth in claim 13, wherein said ejecting system further comprises: a base plate having opposing first and second faces and a groove along the rim of said base plate, said second face being coupled to said inflatable tube, and wherein said transmitting means is a plurality of passages bored through said base plate, the number of said passages equaling the number of said pressure generators.

15. A Variable-Force Payload Ejecting System as set forth in claim 14, wherein said second face of said base plate is coupled to said inflatable tube via an attachment ring.

16. A Variable-Force Payload Ejecting System as set forth in claim 15, wherein said pressure generators and electronics module are mounted onto said first face of said base plate, said pressure generators being aligned with said passages so as to allow pressure to travel through said passages from said generators to said inflatable tube.

17. A Variable-Force Payload Ejecting System as set forth in claim 16, wherein said ejecting system still further comprises a face cover to cover and protect said pressure generators and electronics module.

18. A Variable-Force Payload Ejection System as set forth in claim 17, further comprising a rotation plate, said rotation plate being mounted between said inflatable tube and the item; and wherein said helical stiffener produces said pre-selected spin rate in response to the inflation of said tube.

19. A Variable-Force Payload Ejecting System as set forth in claim 18, wherein said rotation plate is permanently coupled to said stiffener while being detachably coupled to the item, said rotation plate transferring said spin rate to the item in response to said stiffener, thus enabling the item to initiate any arming process.

20. A Variable-Force Payload Ejecting System as set forth in claim 19, wherein said helical stiffener is incorporated into the fabric of said inflatable tube.

* * * * *